US006250319B1

(12) United States Patent
You

(10) Patent No.: US 6,250,319 B1
(45) Date of Patent: Jun. 26, 2001

(54) VENTED UMBRELLA

(76) Inventor: Ching-Chuan You, c/o Percy International Patent Corp. P.O. Box 1-79, Taipei (TW)

( * ) Notice: Subject to any disclaimer, the term of this patent is extended or adjusted under 35 U.S.C. 154(b) by 0 days.

(21) Appl. No.: 09/563,399

(22) Filed: May 3, 2000

(51) Int. Cl.[7] ..... A45B 25/26
(52) U.S. Cl. ..... 135/33.7; 135/33.2
(58) Field of Search ..... 135/33.7, 33.2

(56) References Cited

U.S. PATENT DOCUMENTS 3,032,047 * 5/1962 Wendorf ..... 135/33.7
5,890,506 * 4/1999 Kupferman ..... 135/33.2
6,006,769 * 12/1999 Lin ..... 135/33.7
6,039,063 * 3/2000 Lin et al. ..... 135/33.7
6,155,278 * 12/2000 Lin ..... 135/33.7

FOREIGN PATENT DOCUMENTS

928634 * 12/1947 (FR) ..... 135/33.7

* cited by examiner

*Primary Examiner*—Robert Canfield

(57) ABSTRACT

A vented umbrella is resistant to inversion from the wind and effective in ventilation. The umbrella comprises a foldable frame, a lower canopy, and an upper canopy in a concentric covering relation with respect to lower canopy with a small overlapped peripheral area therebetween. A plurality of nonelastic ropes are provided each connected between the center portion of peripheral edge in each sector of lower canopy and the upper ring. As such, a plurality of openings are formed at the junction between sectors of upper canopy and lower canopy in a fully extended condition. This also can save cloth and effect a simplified manufacturing process.

6 Claims, 7 Drawing Sheets

VENTED UMBRELLA

BACKGROUND OF THE INVENTION

1. Field of the Invention

The present invention relates to umbrellas and more particularly to a vented umbrella that is resistant to inversion from the wind as well as is effective in ventilating air between the underside of umbrella and the upper side thereof.

2. Description of Related Art

Conventionally, an umbrella is a foldable means carried by people for protection against the rain and/or sun. Further, canopy is typically an opaque cloth with a close texture. This also means the permeability thereof is poor. As such, an umbrella user often feels muggy under the hot sun due to the poor ventilation. To the worse, in a rainy windy day, a wind will catch an umbrella user unaware and exert a force against the inner surface of the canopy which will cause the canopy to invert from its normal operable position to an upwardly convex position.

A conventional windproof umbrella is shown in FIG. 4 wherein umbrella 3 comprises a lower canopy 30 and an upper canopy 31. Lower canopy 30 is in a covering position over the fully stretched ribs 41. A plurality of openings 301 are formed on lower canopy 30 wherein each opening 301 is located between two adjacent ribs 41. Upper canopy 31 is smaller than lower canopy 30 in size. Upper canopy 31 is in a concentric covering relation with respect to lower canopy 30 wherein openings 301 are also covered by upper canopy 31. With this, during windy weather, wind caught beneath the upper canopy 31 exits through the openings 301 and applies pressure to the underside of the lower canopy 30. This forces lower canopy 30 lift away from upper canopy 31 to provide a path for wind to escape the umbrella 3.

Another conventional windproof umbrella is shown in FIG. 5 wherein umbrella 5 comprises a lower canopy 50 and an upper canopy 51. Lower canopy 50 is in a covering position over the fully stretched ribs 61. A multilateral canopy 501 is in a concentric covering relation with respect to lower canopy 50. This umbrella 5 also can ventilate air through canopy 501.

But these are unsatisfactory for the purpose for which the invention is concerned for the following reasons:

1. Ventilation is poor. In detail, upper canopy is in a close covering relation with respect to lower canopy, whereby only a small vent exists between upper canopy and lower canopy for ventilating when a strong wind applies pressure to the underside of lower canopy.
2. Cost ineffective. It is seen that lower canopy and upper canopy are relatively large. Further, the covering area of upper canopy with respect to lower canopy is also large, resulting in an increase in the manufacturing cost.
3. Complex manufacturing processes. The provision of openings inevitably complicates the manufacturing processes.

A still another conventional windproof umbrella is shown in FIGS. 6 and 7. This one eliminates the drawbacks of above two prior art umbrellas. In detail, peripheral edge 211 of upper canopy 21 is held taut by attaching elastic strips 22 to the fasteners 121 on stretchers 12 to form a plurality of V-shapes. This can prevent elastic strips 22 from sliding along the stretchers 12 as shown in FIG. 7. A plurality of large openings 204 are formed in the umbrella. However, elastic strips 22 generally have the same orientation as ribs 11, i.e., nearly parallel each other. Also, peripheral edge 211 of upper canopy 21 is partially closed by the open openings 204. To the worse, openings 204 may be closed by a strong wind coming from above the top of umbrella as indicated by arrow A. Thus the ventilation is poor. Further, the elasticity of elastic strips 22 will be worn out as time passes because the elastic strips 22 are often stretched. This in turn causes openings 204 to shrink. Furthermore, the provision of fasteners 121 is time consuming in assembly, resulting in an increase in the manufacturing cost.

SUMMARY OF THE INVENTION

It is an object of the present invention to provide a vented umbrella having the features of resistant to inversion from the wind, effective in ventilating air between the underside of umbrella and the upper side thereof, fabric saving, and simplified manufacturing process.

To achieve the above and other objects, the present invention provides a vented umbrella comprising a frame and a canopy covered on the stretched frame wherein the frame includes a shank, a hub, an upper ring, and a lower ring all provided on the shank, a plurality of ribs, and a plurality of stretchers being foldable. Canopy includes a lower canopy and an upper canopy in a concentric partial covering relation with respect to lower canopy with a small overlapped peripheral area therebetween. The peripheral edge of upper canopy is covered on the upper peripheral edge of lower canopy. A plurality of nonelastic ropes are provided each connected between the center portion of peripheral edge in each sectors of lower canopy and the upper ring. As such, an opening is formed at the junction between each sectors of upper canopy and lower canopy when the umbrella is fully extended. Thus an effective ventilation in the umbrella is achieved.

The above and other objects, features and advantages of the present invention will become apparent from the following detailed description taken with the accompanying drawings.

DETAILED DESCRIPTION OF THE PREFERRED EMBODIMENTS

Figure 1:
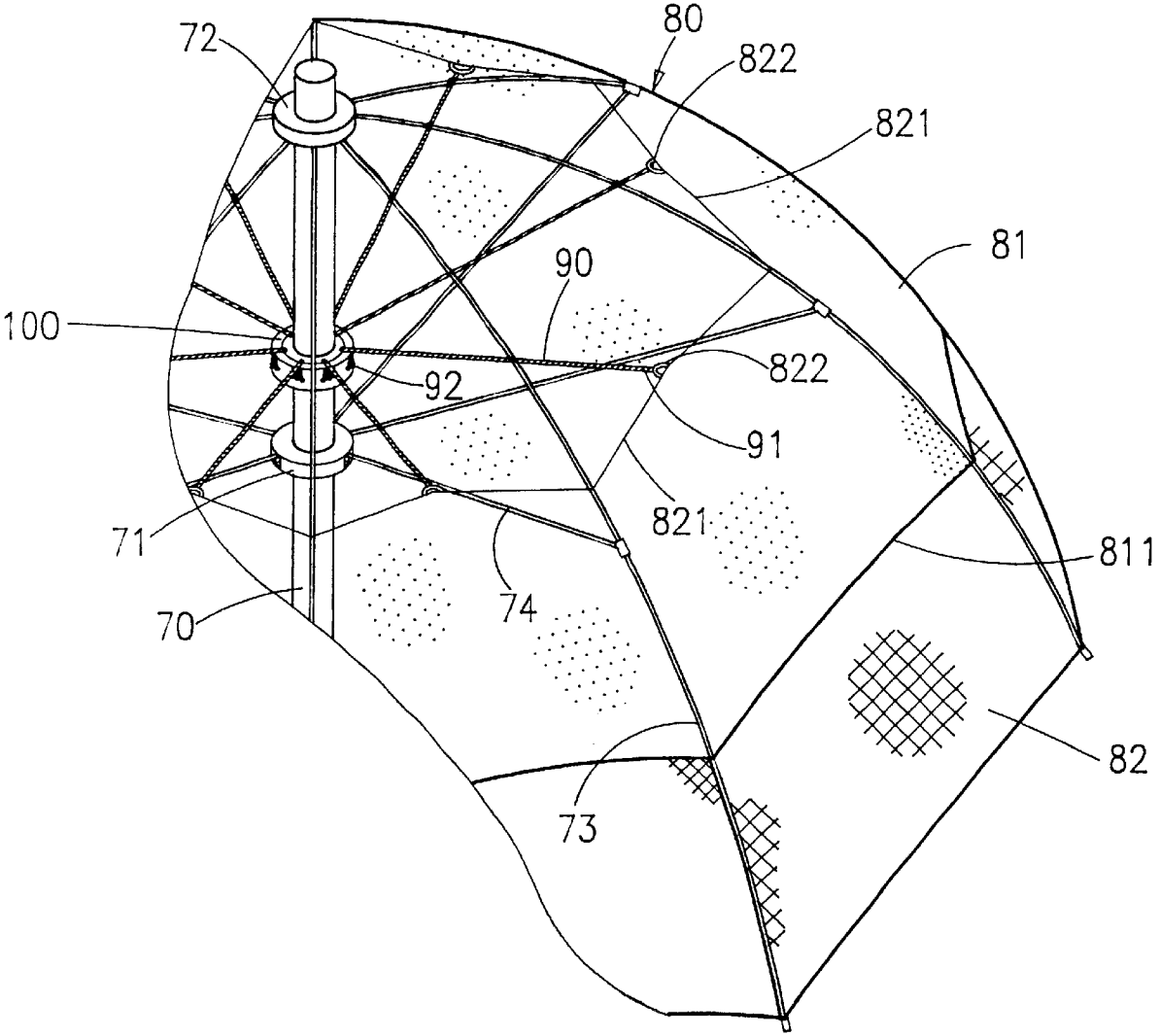
FIG. 1 is a partial perspective view of a first preferred embodiment of vented umbrella according to the invention, viewed from above the umbrella.
Figure 3:
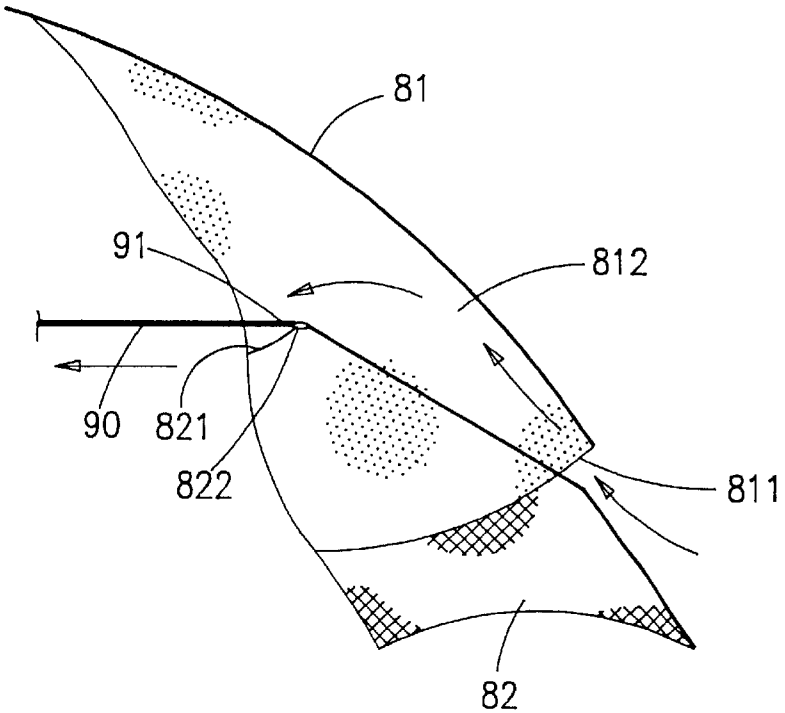
FIG. 3 is a side view illustrating the wind flow in the umbrella of the invention.
Figure 7:
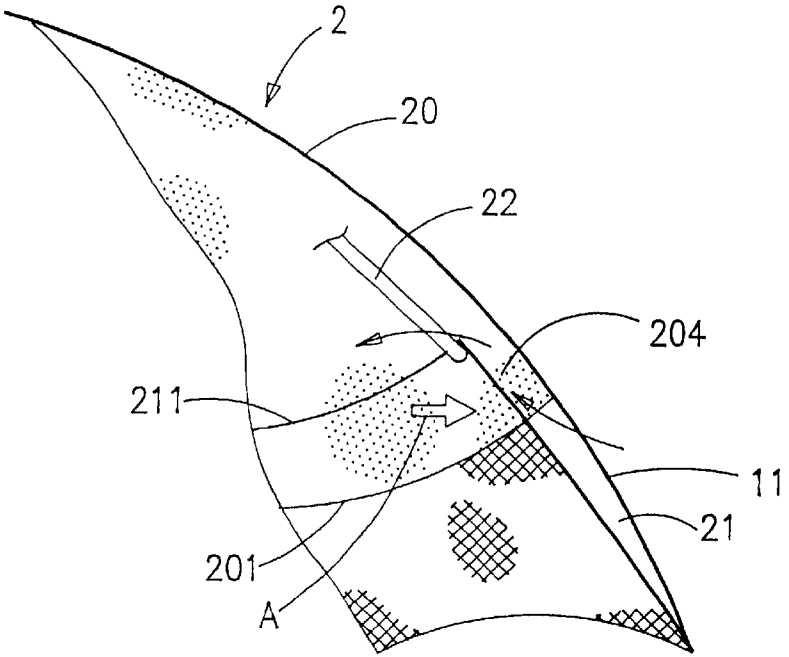
FIG. 7 (PRIOR ART)
FIG. 7 is a side view illustrating the wind flow in the windproof umbrella of FIG. 6.
Figure 4:
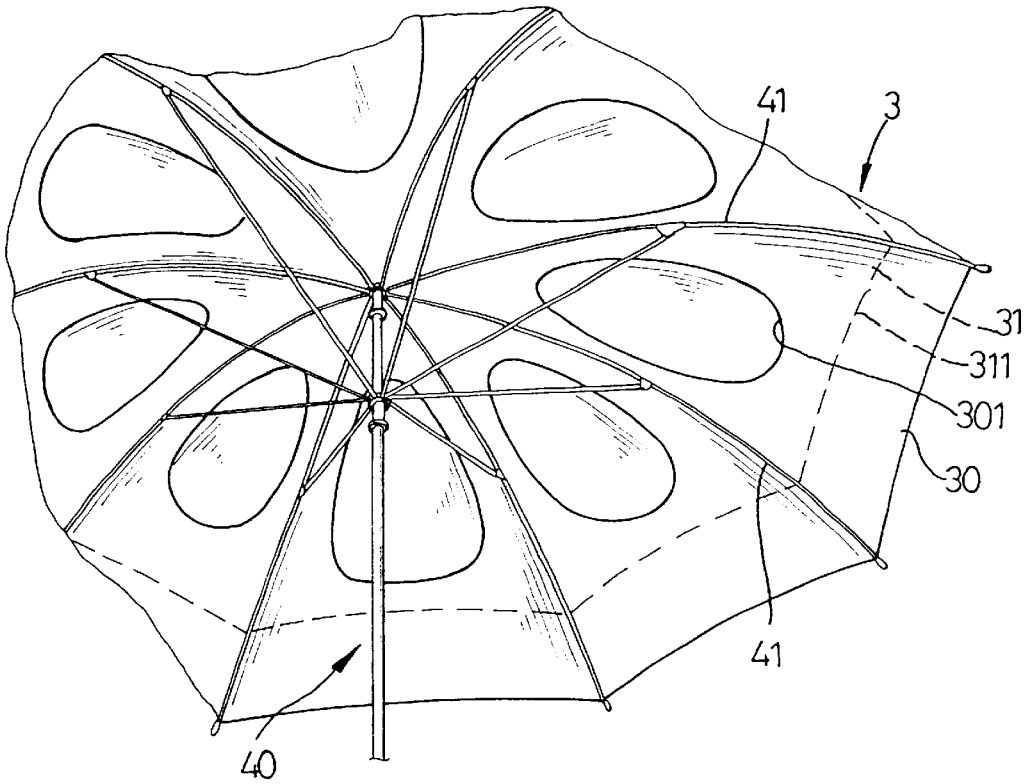
FIG. 4 (PRIOR ART)
FIG. 4 is a perspective view of a first conventional windproof umbrella, viewed from below the umbrella.
Figure 5:
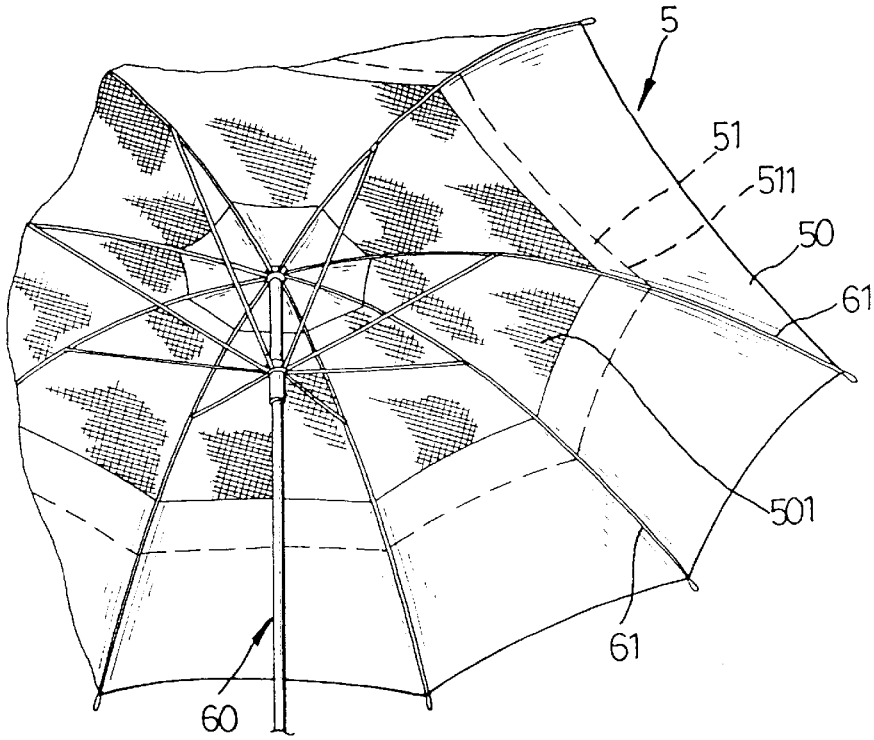
FIG. 5 (PRIOR ART)
FIG. 5 is a perspective view of a second conventional windproof umbrella, viewed from below the umbrella.
Figure 6:
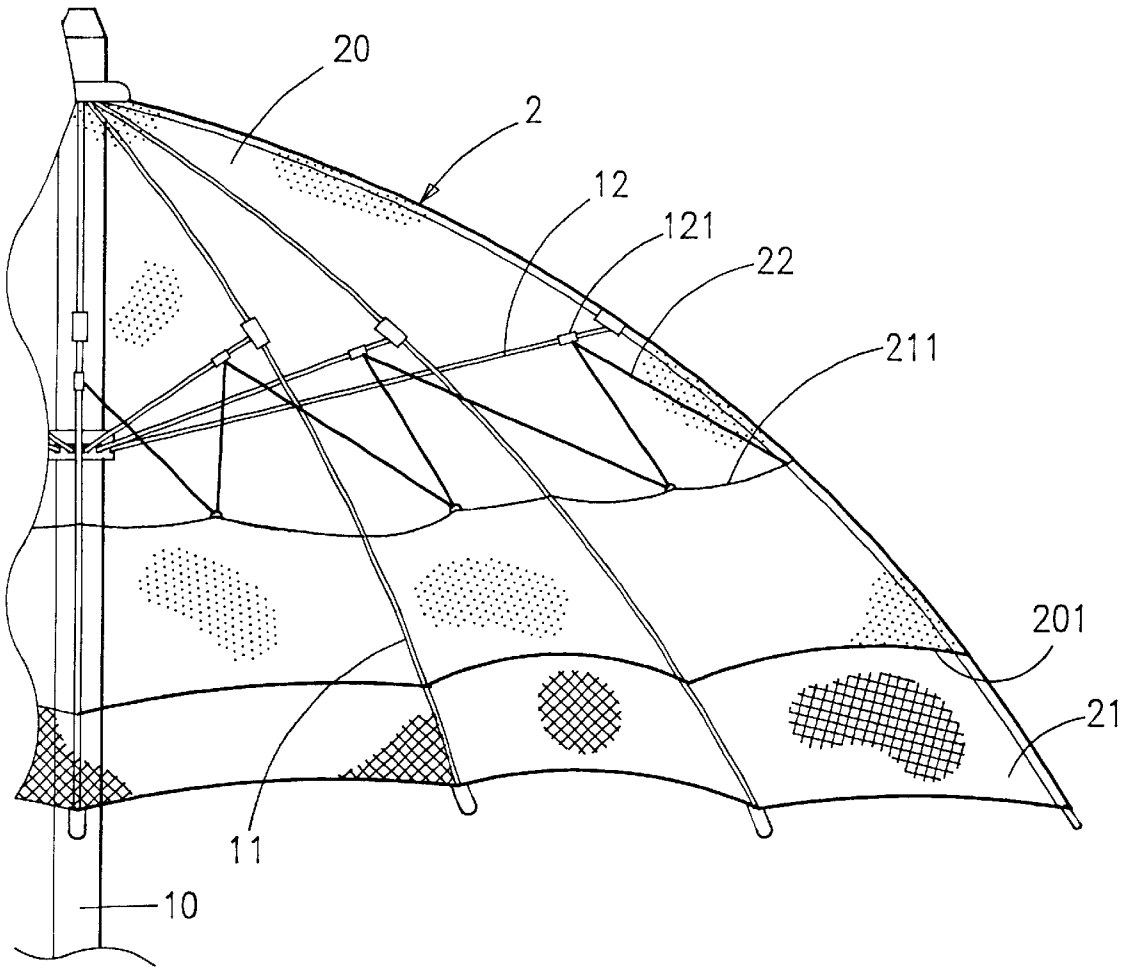
FIG. 6 (PRIOR ART)
FIG. 6 is a perspective view of a third conventional windproof umbrella, viewed from the side of umbrella.

Referring to FIGS. 1 and 3, there is shown a vented umbrella constructed in accordance with the invention. The frame of umbrella comprises a shank 70, an lower ring 71 and a hub 72 both provided around the shank 70, a plurality of ribs 73, and a plurality of stretchers 74 being foldable. Canopy 80 covered on the stretched frame includes a lower canopy 82 and an upper canopy 81. It is designed that the upper canopy 81 occupies about 60% to 80% of the total area of umbrella 80. The upper peripheral edge 821 of lower canopy 82 is extended from a position above the lower peripheral edge 811 of upper canopy 81. As such, upper canopy 81 is in a concentric partial covering relation with respect to the lower canopy 82 with a small peripheral area being overlapped between lower canopy 82 and upper canopy 81.

Moreover, a plurality of generally horizontally extending ropes 90 are provided each having one end 91 stitched or fastened to the center portion of upper peripheral edge 821 in each sector of lower canopy 82 and the other end 92 thereof stitched or fastened to each of plurality holes on the upper ring 100 fixed on the shank 70. With these approximately horizontally supporting forces of ropes 90, a plurality of large openings 812 are formed at the overlapped areas between the lower peripheral edge 811 of upper canopy 81 and the upper peripheral edge 821 of lower canopy 82 when umbrella is fully extended (see FIG. 3). It is seen that rope 90 is preferably kept at the approximately horizontal orientation with respect to the shank 70 even at the strong wind condition and thus, as stated above, a plurality of openings 812 are generated between the lower peripheral edge 811 of the upper canopy 81 and the upper peripheral edge 821 of the lower canopy 82 for allowing wind to easily pass through. Further, the orientation of rope 90 according to the present invention is preferable at an angle of about 45 degrees with respect to the rib 73, or at an angle of about 90 degrees with respect to the shank 70, when upper canopy 81 is stretched outward to the full. Accordingly, the openings 812 can also be expanded to the full, resulting in a better ventilation.

Figure 2A:
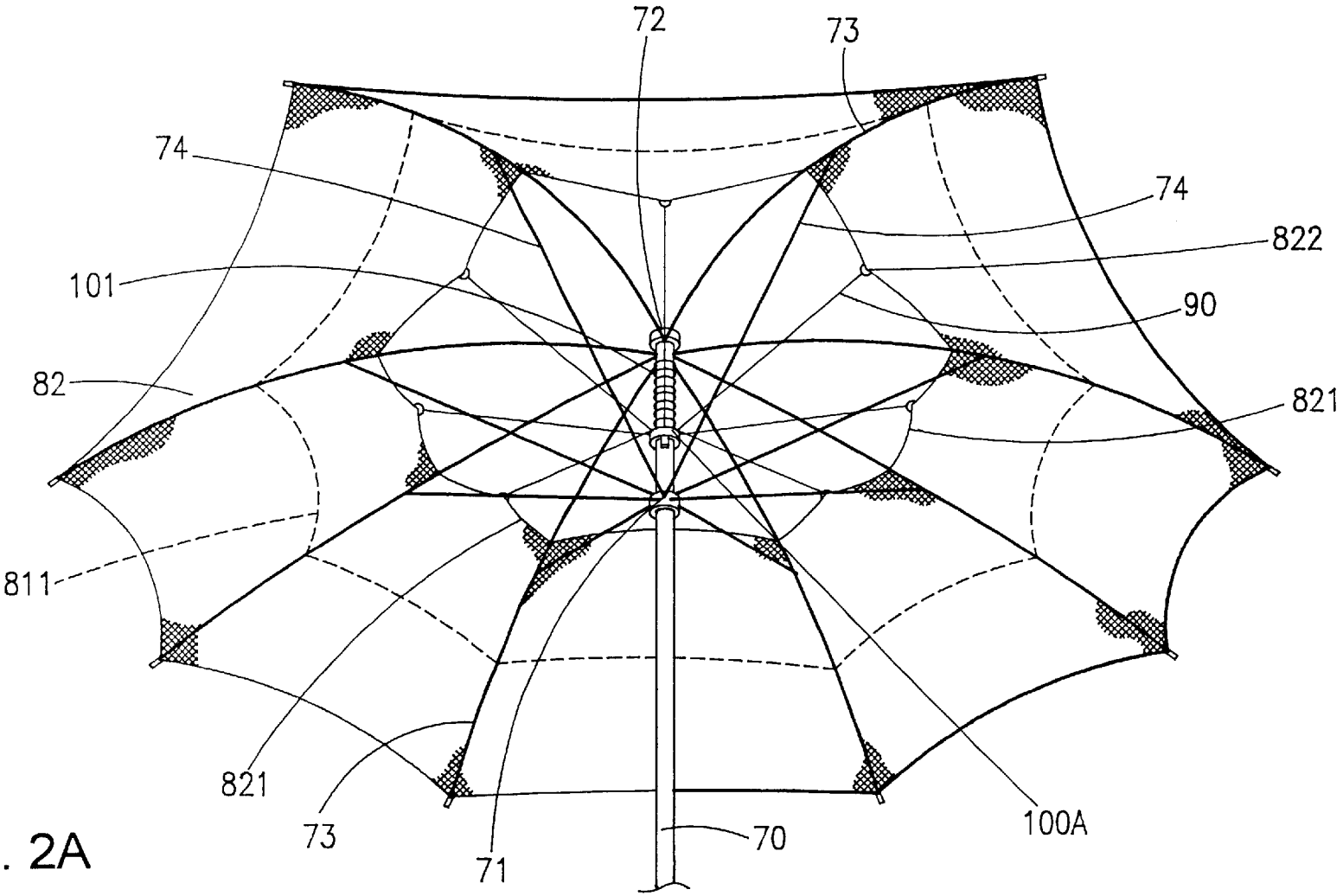
FIG. 2A is a perspective view of a second preferred embodiment of vented umbrella according to the invention, viewed from below the umbrella.
Figure 2B:
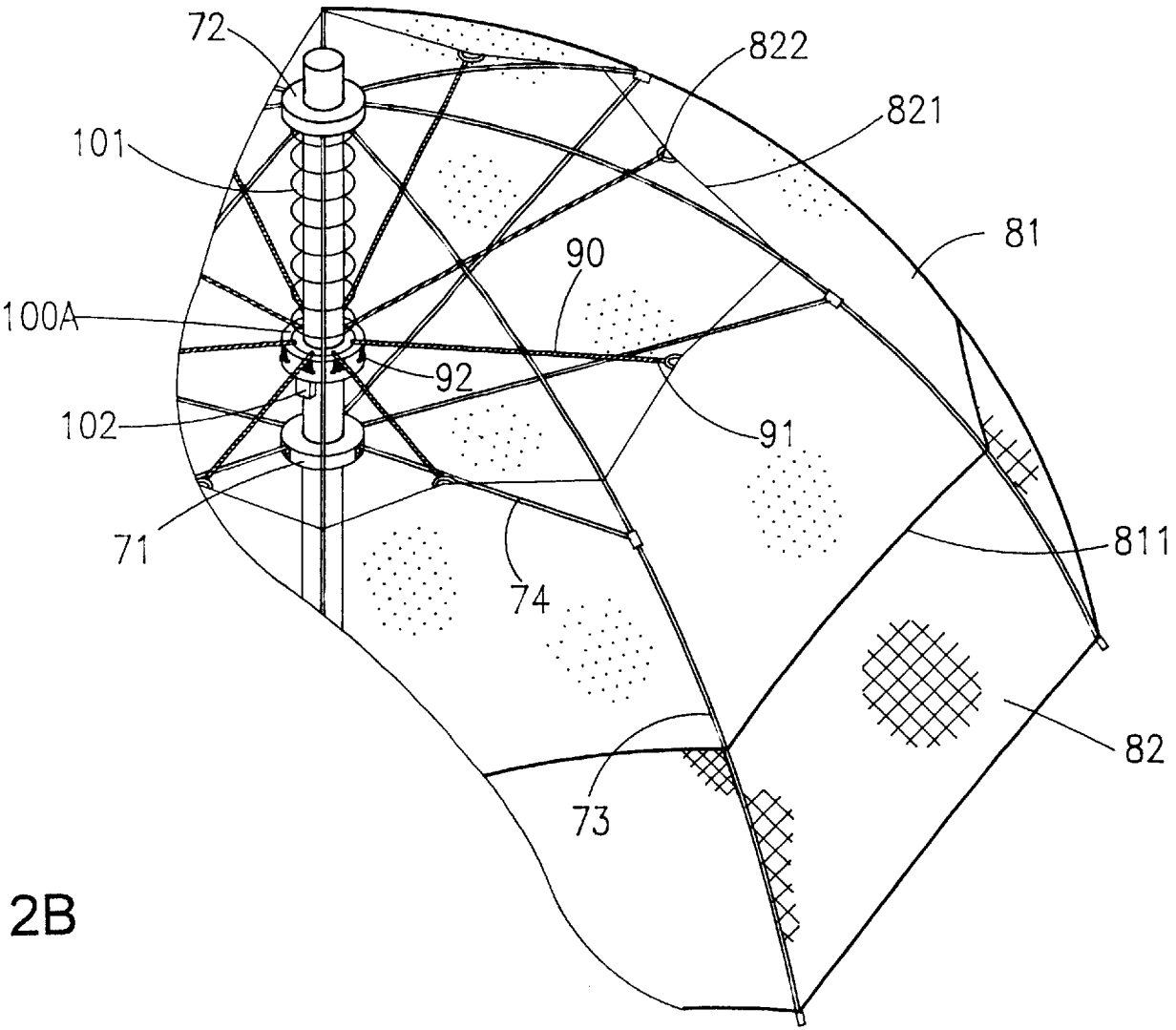
FIG. 2B is another partial perspective view of FIG. 2A, viewed from above the umbrella.
Figure 2C:
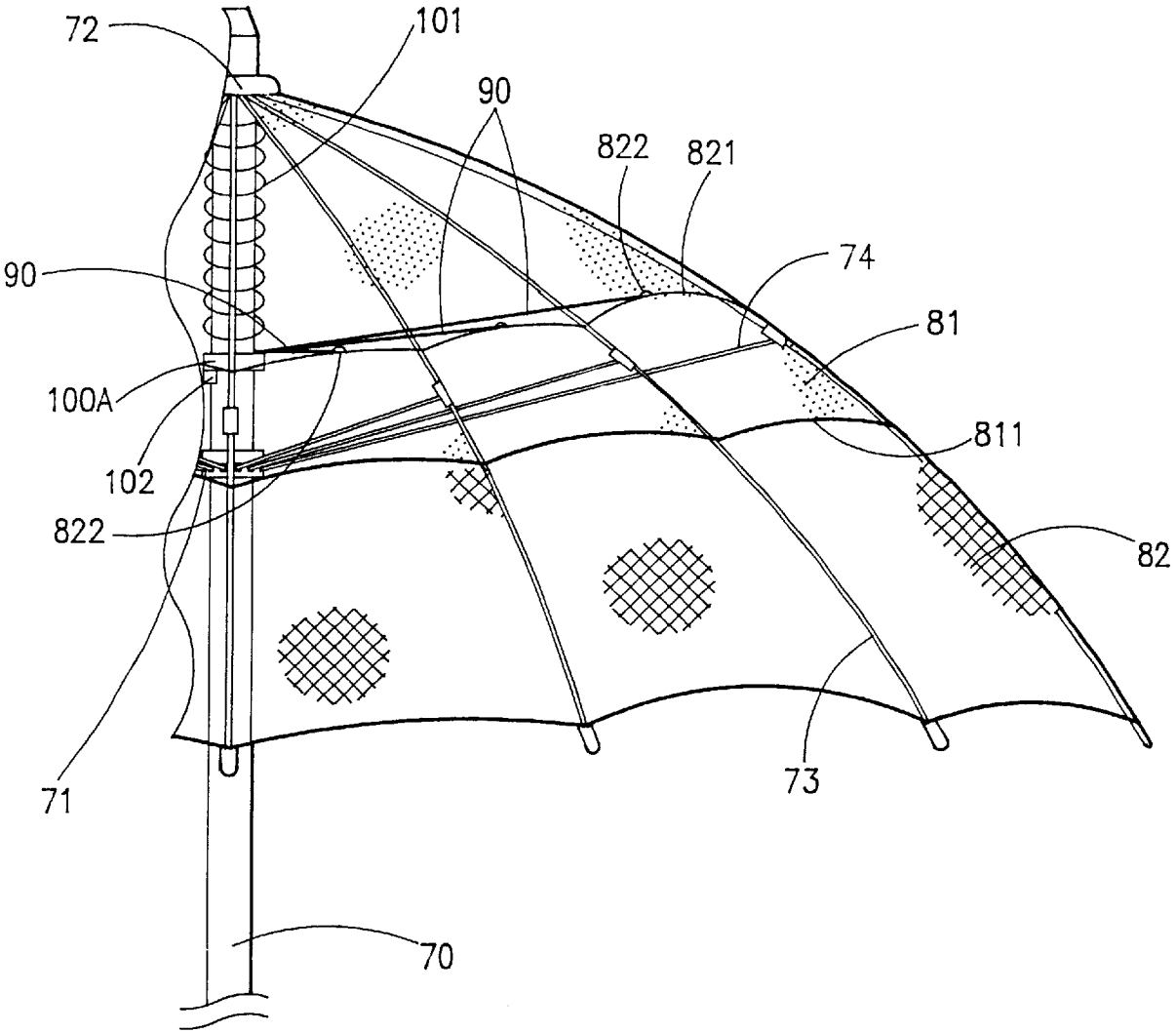
FIG. 2C is partial perspective view of FIG. 2B, viewed from the side.

FIGS. 2A, 2B, and 2C illustrate a second preferred embodiment of vented umbrella according to the invention. This embodiment is generally the same as the first one except the followings. Upper ring 100 of the first embodiment is replaced by a slidable upper ring 100A. Further, a helical spring 101 is biased between upper ring 100A and hub 72. Furthermore, a tab 102 is provided on shank 70 between upper ring 100A and lower ring 71 for defining the lowest position of upper ring 100A, i.e., abutted on tab 102. With this configuration, the tautness of rope 90 is adapted to the strength of wind. Also, the size of opening 812 is also adapted to the strength of wind.

Note that in effect, the orientation of rope 90 may be at an angle other than 45 degrees with respect to rib 73 as implemented in above two embodiments. For example, when the second end 92 of rope 90 is in a fixed point, while the first end 91 of rope 90 is varied, the orientation of rope 90 has an angle between −45° and +45° with respect to the horizontal direction of the shank 70 is also possible. In addition, the rope 90 is preferable a nonelastic rope to prevent the tension of the rope from loosening when the umbrella is used for a period of time. It is to be understood that an arrangement of said plurality of ropes 90 according to the present invention is preferably positioned on the upper space of said plurality of stretchers 74, as shown in FIGS. 1 to 3, in order to prevent from being interfered by both said stretchers 74 and said ropes 90 when the umbrella is in a closed condition.

While the invention herein disclosed has been described by means of specific embodiments, numerous modifications and variations could be made thereto by those skilled in the art without departing from the scope and spirit of the invention set forth in the claims.

What is claimed is:

1. A vented umbrella comprising:

a frame including
- a shank;
- a hub fixedly mounted on the top of the shank;
- an upper ring slidably mounted on the shank;
- a lower ring slidably mounted on the shank;
- a plurality of ribs, each having one end linked to the hub;
- a plurality of stretchers, each having one end pivotally linked to the lower ring and an other end thereof pivotally linked to a middle portion of a corresponding one of the ribs;

a canopy covered on the stretched frame including a lower canopy and an upper canopy each consisting of a plurality of sectors wherein the upper canopy is in a concentric partial covering relation with respect to the lower canopy with a predetermined overlapped peripheral area therebetween and a peripheral edge of the upper canopy is covered on an upper peripheral edge of the lower canopy; and a plurality of ropes each secured between the upper peripheral edge in each sectors of the lower canopy and the upper ring;

whereby a plurality of openings are formed at the overlapped peripheral area between the sectors of the upper canopy and the corresponding sectors of the lower canopy in a fully extended condition.

2. The vented umbrella of claim 1, wherein the upper ring is slidable, further comprising a helical spring biased between the slidable upper ring and the hub and a tab provided on the shank between the slidable upper ring and the lower ring for defining the lowest position of the upper ring whereby the tautness of each of the ropes is varied, resulting in a variation of the size of each of the openings.

3. The vented umbrella of claim 1, wherein each of the ropes is secured between a center portion of the upper peripheral edge in each sectors of the lower canopy and the upper ring, respectively.

4. The vented umbrella of claim 1, wherein an orientation of each of the ropes is at an angle between −45° and +45° with respect to a horizontal direction of the shank.

5. The vented umbrella of claim 1, wherein each of the ropes is nonelastic.

6. The vented umbrella of claim 1, wherein the ropes are positioned above the plurality of the stretchers of the umbrella.

* * * * *